United States Patent [19]

Bower et al.

[11] 4,139,325

[45] Feb. 13, 1979

[54] MINE ROOF SUPPORTS

[75] Inventors: Lewis R. Bower; Malcolm Wake, both of Horbury, England

[73] Assignee: Fletcher Sutcliffe Wild Limited, Horbury, England

[21] Appl. No.: 917,405

[22] Filed: Jun. 20, 1978

[30] Foreign Application Priority Data

Nov. 1, 1977 [GB] United Kingdom ..... 45376/77

[51] Int. Cl.[2] ..... E21D 15/44

[52] U.S. Cl. ..... 405/291

[58] Field of Search ..... 61/45 D, 63; 299/31-33; 248/357; 91/170 MP

[56] References Cited

U.S. PATENT DOCUMENTS

| | | | |
|---|---|---|---|
| 3,357,742 | 12/1967 | Dommann et al. | 299/32 |
| 3,640,581 | 2/1972 | Rassmann et al. | 299/32 |
| 3,915,500 | 10/1975 | Schlusener et al. | 61/45 D X |

FOREIGN PATENT DOCUMENTS

| | | | |
|---|---|---|---|
| 2408856 | 9/1975 | Fed. Rep. of Germany | 299/32 |

*Primary Examiner*—Dennis L. Taylor

*Attorney, Agent, or Firm*—Lowe, King, Price & Becker

[57] ABSTRACT

A mining installation comprises an armoured conveyor made up of a plurality of pans articulated together end-to-end, a plurality of hydraulically powered, self-advancing mine roof supports located side by side along the goaf side of the conveyor, each roof support being connected to a pan by one or more double-acting advancing rams, and each having a base means incorporating a pair of spaced, elongate base members seating on a mine fooor, each support further having a forward end intended to be located, in use, adjacent the goaf side of the conveyor and a rearward end intended to be remote from the conveyor, a rail located between the base members and attached at a forward end thereof to a pan of the conveyor, and a lifting jack carried by the base members at or near the front end thereof and operable on the rail to lift the front ends of the base members from the mine floor and in this condition be advanced towards the conveyor by operation of the one or more double-acting advancing rams.

10 Claims, 5 Drawing Figures

MINE ROOF SUPPORTS

This invention relates to mining installations incorporating hydraulically powered, self-advancing mine roof supports.

Such supports are usually located at the goaf side of an armoured conveyor made up of a plurality of pans articulated together end-to-end, each roof support being connected to a pan by one or more double-acting advancing rams, with such rams operable in a first direction to advance the conveyor with respect to the support, in accordance with the rate of advance of the mineral face involved, and operable in a second direction to advance the support to the new conveyor position. However, mine floors often present obstructions to the advance of the support e.g. by the floor being holed, humped, or when the supports find themselves on "soft" floors, when it is necessary to lift e.g. by hydraulic jacks, packing pieces etc. the base members of the supports from the holes in which they find themselves located as a result of their roof supporting function. Such delays in roof support advance invariably lead to delays in mineral cutting operations and hence loss of production.

According to the present invention, a mining installation comprises an armoured conveyor made up of a plurality of pans articulated together end-to-end, a plurality of hydraulically powered, self-advancing mine roof supports located side by side along the goaf side of the conveyor, each roof support being connected to a pan by one or more double-acting advancing rams, and each having a base means incorporating a pair of spaced, elongate base members seating on a mine floor, each support further having a forward end intended to be located, in use, adjacent the goaf side of the conveyor and a rearward end intened to be remote from the conveyor, a rail located between the base members and attached at a forward end thereof to a pan of the conveyor, and a lifting jack carried by the base members at or near the front end thereof and operable on the rail to lift the front ends of the base members from the mine floor and in this condition be advanced towards the conveyor by operation of the one or more double-acting advancing rams.

Thus, the provision of the rail creates an artificial floor along which the forward end of the roof support may be slid forward when the front end is lifted by actuation of the lifting ram, the rearward end sliding along the mine floor.

In a first embodiment, the rearward end of the rail may be slidable over the mine floor. Preferably, the rail is provided with one or more laterally extending guide projections intended to have a guiding effect on the rail, during relative displacement with respect to the spaced apart base members, by contact with those members and in particular mutually opposite inner sidewalls thereof. In detail, the rail may be provided with both forward and rearward guide pins.

In a second embodiment, the rearward end of the rail may be slidably suspended by means carried by the spaced apart base members.

In detail, each base member may be provided with a slide shelf e.g. welded externally to each base member, and conveniently these shelves are bridged by a slide member attached to the rearward end of the beam. The slide member is preferably a pin so that the rail may readily pivot at its rearward end on the shelves during actuation of the lifting ram.

For either of the above embodiments, the rail may conveniently be a length of conventional railway rail, the lifting ram being operable on the rail head. Attachment of the forward end of the rail to a conveyor pan may be to the conventional clevis rail of the pan and for this purpose the forward end of the rail may itself, be forked or bi-furcated, or may have welded thereto a forked or bi-furcated member.

The invention will now be described in greater detail, by way of example with reference to the accompanying drawings, in which.

Figure 1:
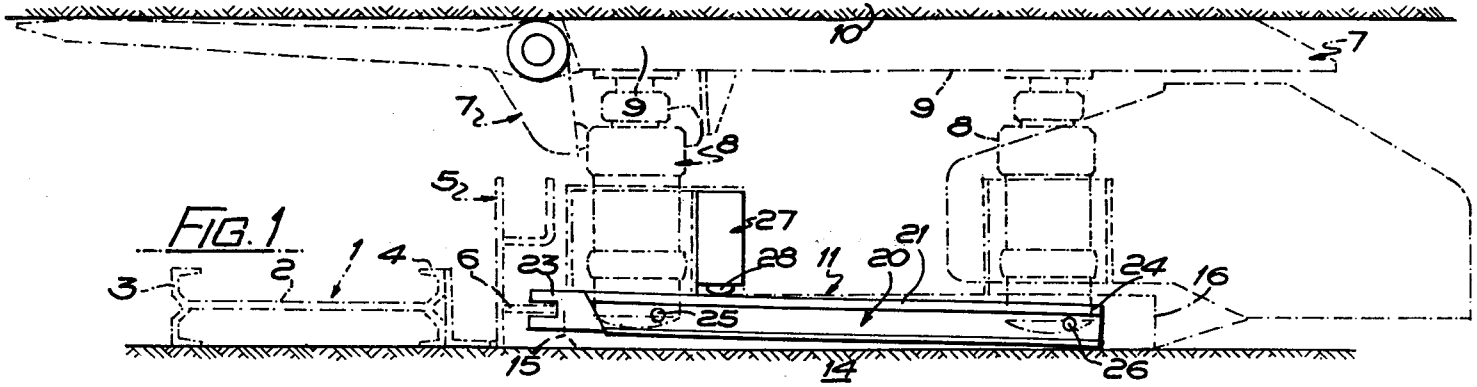
FIG. 1 is a side elevation of a first embodiment of mine installation in accordance with the present invention.
Figure 4:
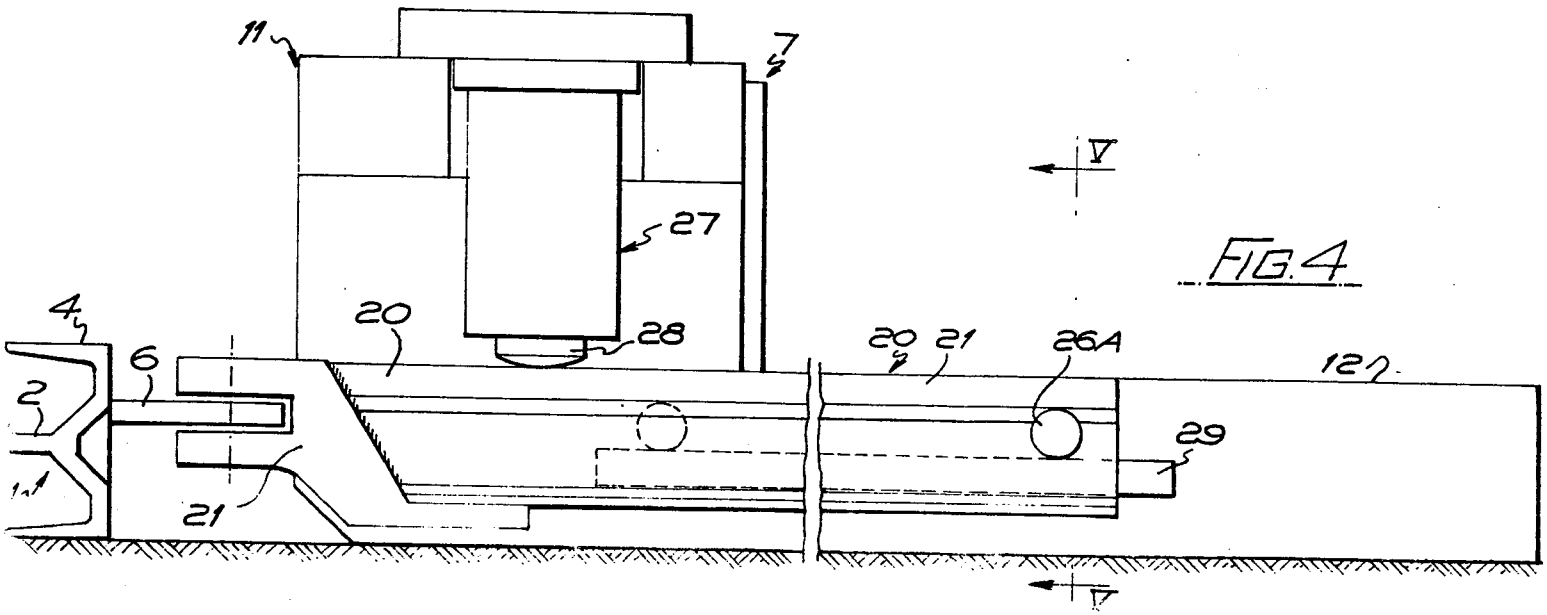
Figure 5:
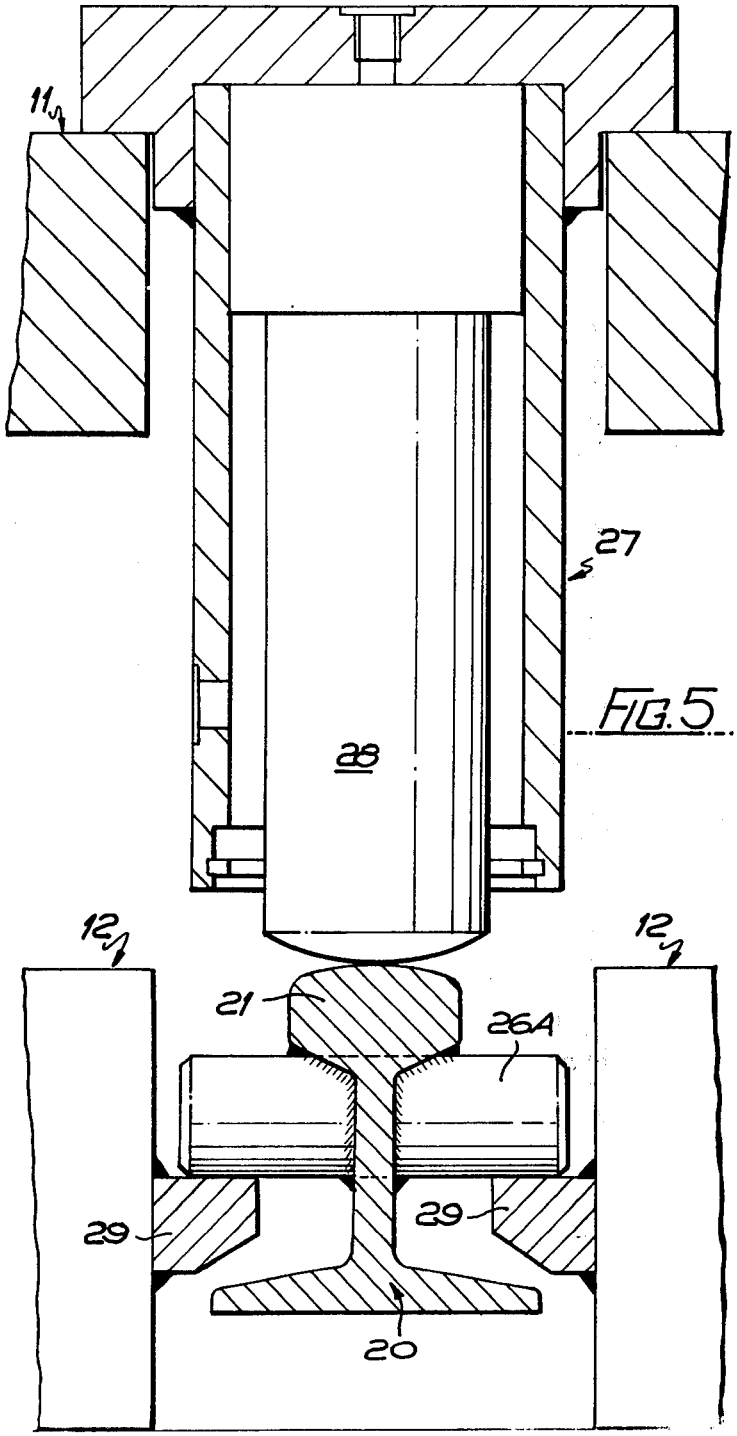

FIG. 4 corresponds to a lower portion of the installation of FIG. 1 but shows a second embodiment and;

FIG. 5 is a section on the line V — V of FIG. 4, to a larger scale

In the drawings, of both embodiments, like components are accorded like reference numerals.

Figure 2:
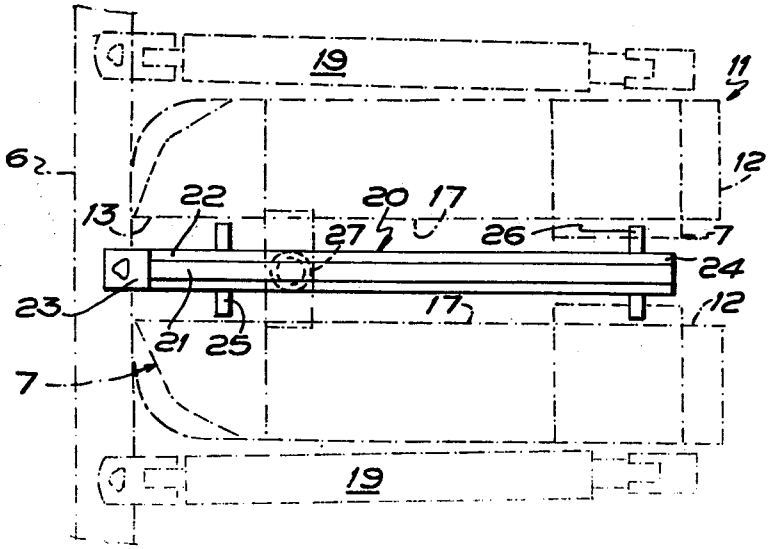
FIG. 2 is a plan view of FIG. 1.
Figure 3:
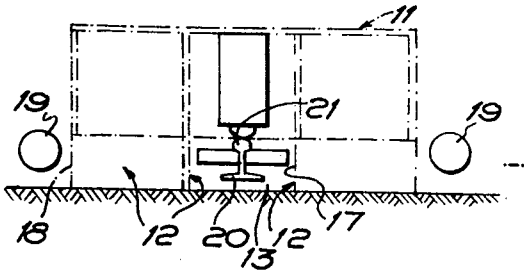
FIG. 3 is a section on the line III — III of FIG. 1.

In the embodiment of FIGS. 1 to 3, the mine installation comprises an armoured conveyor 1 of conventional configuration comprising a pan 2 having a sidewall 3 located opposite a mineral face (not shown) and a goaf sidewall 4. A plurality of such pans are secured together end-to-end in known articulated manner to constitute the conveyor 1. To the sidewall 4 is attached a cable handling/spill plate assembly 5 having a clevis rail 6.

A plurality of hydraulically powered self-advancing mine roof supports 7 are located side by side along the goaf sidewall 4 of the conveyor. Each support 7 comprises a pair of forward and a pair of rearward hydraulically extensible chock legs 8 carrying at their upper ends one or more roof beams 9 to support a mine roof 10 and seated at their lower ends on a base means 11 incorporating a pair of parallel, spaced apart, elongated base members 12, which define a tunnel 13, the base members 12 in turn seating on a mine floor 14. Each base member 12 has a forward end 15, a rearward end 16, an inner sidewall 17 and an outer sidewall 18. Adjacent each outer sidewall 18 is located a double-acting hydraulic advancing ram 19, one end of which is attached to a sidewall 10 and the other end of which is attached to the clevis rail 6 of an adjacent pan 2, and in FIG. 1, the rams 19 are shown in their fully retracted condition.

In the tunnel 13 is located a length of rail 20 having a head 21, a forward end 22 to which is welded a forked member 23 attached in the conventional manner to the clevis rail 6. The rail 20 also has a rearward end 24, which, in the embodiment of FIGS. 1 to 3, seats on the mine floor 14. The rail 20 is provided with forward and rearward laterally extending guide pins 25, 26, each of a length such that they fit, with slight clearance, in the width of the tunnel 13 defined between mutually opposite inner sidewalls 17. Adjacent the forward chock legs 8, the base means 11 carries a lifting jack 27, a piston 28 of which is operable on the rail head 21.

Each pan 2 is advanced at an appropriate time during mining operation by extending the ram 19 i.e. at the time when it is desired to advance the conveyor 1 towards a newly exposed mineral face after passage of a mineral winning device, such extension of the rams 19 being effected while the chock legs 8 are pressurised. When thereafter it is required to advance the support 7 in turn towards a previously advanced pan 2, pressure is released in the chock legs 8, which may or may not remove the roof beam(s) 9 from the roof 10, and the rams 19 are retracted to pull the roof support 7 forwards by re-acting on the conveyor 1. However, in order to obviate forward ends 15 of the base members 12 fouling an obstruction in the mine floor 14 e.g. in soft floor conditions, the lifting jack 27 is extended which reacts upon the rail head 21 to result in the forward end of the roof support 7 and in particular the forward ends 15 of both base members 12 being lifted from the mine floor 14, and for example out of any hole in which they may find themselves, so that when the rams 19 are retracted, the forward end of the roof support 7 slides forward on the rail 20 while the rearward ends of both base members 12 slide along the mine floor 14. During such relative displacement between the rail 20 and the roof support 7, the rail is guided into, or out of, the tunnel 13 by the ends of the guide pins 25 and 26 sliding along the inner sidewalls 17.

In the embodiment of FIGS. 4 and 5, the rearward end 24 of the rail 20 is provided with a laterally extending suspension pin 26A, while a shelf 29 is welded to each inner sidewall 17, the length of pin 26A being sufficient to bridge the shelves 29.

The mode of operation of the mine installation of the second embodiment is much the same as that already described for the first embodiment, except that the rear end 24 of the rail 20 slides in suspended manner, into and out of the tunnel 13, along the shelves 29.

What we claim is:

1. A mining installation comprising an armoured conveyor made up of a plurality of pans articulated together end-to-end, a plurality of hydraulically powered, self-advancing mine roof supports located side by side along a goaf side of said conveyor, one or more double-acting advancing rams connecting each roof support to one of said pans, each of said roof supports having a base means, a pair of spaced apart, elongate base members being incorporated in said base means and seating on a mine floor, each of said supports having a forward end intended to be located, in use, adjacent said goaf side of said conveyor and a rearward end intended to be remote from said conveyor, a rail located between said spaced apart base members and attached at a forward end thereof to one of said pans of said conveyor, and a lifting jack carried by said base members at or near said front end thereof and operable on said rail to lift said front ends of said base members from said mine floor and in this condition be advanced towards said conveyor by operation of said one or more double-acting advancing rams.

2. A mining installation as claimed in claim 1, wherein said rearward end of said rail is slidable over said mine floor.

3. A mining installation as claimed in claim 2, wherein one or more laterally extending guide projections are provided on said rail.

4. A mining installation as claimed in claim 3, wherein forward and rearward guide pins constitute said guide projections.

5. A mining installation as claimed in claim 1, comprising means carried by said spaced apart base members for slidably suspending said rearward end of said rail.

6. A mining installation as claimed in claim 5, wherein a slide shelf is provided on each of said pair of base members, a slide member attached to the rearward end of the beam bridging said slide shelves of said pair.

7. A mining installation as claimed in claim 6, wherein a pin constitutes said slide member.

8. A mining installation as claimed in claim 1, wherein a length of conventional railway rail constitutes said rail, said lifting ram being operable on the head of said railway rail.

9. A mining installation as claimed in claim 1, wherein said forward end of said rail is forked.

10. A mining installation as claimed in claim 1, wherein a forked member is welded to said forward end of said rail.

* * * * *